United States Patent [19]

Cairns

[11] 4,273,403

[45] Jun. 16, 1981

[54] LOCKING STRUCTURE FOR ELECTRICAL CONNECTORS

[75] Inventor: Thomas M. Cairns, Birmingham, Mich.

[73] Assignee: Ford Motor Company, Dearborn, Mich.

[21] Appl. No.: 117,420

[22] Filed: Feb. 1, 1980

[51] Int. Cl.[3] ..... H01R 13/627

[52] U.S. Cl. ..... 339/91 R; 285/DIG. 22

[58] Field of Search ..... 339/75 R, 17, 91 R, 339/255 P, 260, 261, 186 M, 184 M; 285/DIG. 22; 252/31

[56] References Cited

U.S. PATENT DOCUMENTS

| | | | |
|---|---|---|---|
| 3,933,406 | 1/1976 | Cameron et al. | 339/91 R |
| 4,026,624 | 5/1977 | Boag | 339/91 R |

*Primary Examiner*—Eugene F. Desmond

*Attorney, Agent, or Firm*—Paul K. Godwin, Jr.; Clifford L. Sadler; Peter Abolins

[57] ABSTRACT

This specification discloses a pair of matable electrical connectors. The locking structure includes a ramp member formed on one of the connectors and a pair of cantilevered beams formed on the other connector. The cantilever beams have an enlarged portion which coacts with a flat locking surface on the ramp member. The ramp member also includes a prow like wedge which is adjacent the flat locking surface. Deflection of the cantilevered beam enlarged portion from the locking surface to the wedge aligns the enlarged portion so that it can be withdrawn from the ramp member while the wedge spreads the cantilevered beams apart. During mating of the connectors, the cantilevered beams ride up and down on the ramp member until they reach the flat locking surface. During unmating of the connectors, the cantilevered beams are squeezed down and then pulled so that the wedge spreads the beams. Unless the beams are deflected to clear the flat locking surface, the enlarged portions of the beams engage the locking surface to resist unmating of the electrical connectors.

6 Claims, 11 Drawing Figures

LOCKING STRUCTURE FOR ELECTRICAL CONNECTORS

BACKGROUND OF THE INVENTION (1) Field of the Invention

This invention relates to matable electrical connectors for establishing the circuits between pairs of connectors. In particular, the present invention is concerned with the mechanism by which matable connectors are maintained in assembled relationship.

(2) Prior Art

Electrical connectors of the general type described above are disclosed in U.S. Pat. No. 3,933,406 issued Jan. 20, 1976 for an Electrical Connector Block Assembly Having Overcenter Locking, which patent is assigned to the same assignee as this patent application. The above noted patent is hereby incorporated by reference. The above noted patent contains an excellent discussion of the requirements associated with mating of electrical connectors, particularly those electrical connectors which are utilized in automotive vehicles. That patent also contains a description of the prior art and shows a particular system for overcoming the disadvantages noted in the prior art. That patent also contains a full discussion of the requirements for securing proper mating of electrical connections and the desirability of providing an electrical connector which gives all the desired mating characteristics while permitting easy unmating of such connectors when separation of the connectors is desired.

Additionally, another electrical connector is disclosed in U.S. Pat. No. 4,026,624 issued May 31, 1977 for Locking Structure For Electrical Connectors, which patent is assigned to the same assignee as this application. That patent is also incorporated by reference and teaches an overcenter locking structure having a cantilevered beam which rides up one ramp and down another. In accordance with the disclosed structure, both intended and unintended unmating can be achieved by application of the same required force pulling the two electrical connectors apart. Thus, the double ramp configuration insures that at least a minimum connecting force is used thus providing for a good electrical connection. Unfortunately, the force required for undesired unmating is not substantially larger than that required for desired unmating. These are some of the problems this invention overcomes.

SUMMARY OF THE INVENTION

This invention teaches a pair of matable electrical connectors. A ramp member formed on the first of the pair of matable connectors has a generally fixed width with a flat lock surface generally perpendicular to the direction of movement to mate the pair of electrical connectors. The ramp member also includes a prow like wedge positioned adjacent the flat lock surface and pointing away from a second of the pair of matable connectors. A pair of cantilevered beams is formed on the second of the pair of matable connectors. Supporting portions of each of the cantilevered beams extend upwardly from a rear portion of a surface of the second connector. The cantilever beams project forwardly from a parallel, spaced relationship towards a front face of the first connector. The spacing between the cantilever beams is slightly greater than the generally fixed width of the ramp member. Each of the cantilever beams has, at its own projecting free end, an enlarged portion, which projects into the space between the cantilever beams. Each enlarged portion projects towards, but not into engagement with the enlarged portion of the other, whereby a space exists between the two enlarged portions. The cantilever beams are deflected upwardly by engagement with the ramp member, while the enlarged portions pass over the ramp member and are positioned adjacent the flat lock surface so as to lock together the pair of matable electrical connectors. Manual downward deflection of the cantilever beams positions the enlarged portions adjacent the prow like wedge. The enlarged portions are permitted to be drawn along the wedge of the ramp member while it spreads the cantilever beams apart to permit easy unmating of the two connectors.

This invention offers the advantage that it provides a squeeze and pull capability which makes desired disconnection easier to accomplish. When the cantilever beams are not squeezed, there is a substantially greater resistance to unmating forces than when they are squeezed. Further, there are no rearwardly opening recesses which could catch on wires or cables as the connectors are being disconnected. There is also retained a "go-no-go" feature in that the force of raising the beams to ride over the ramp is greater than the force required to mate the electrical terminals within the pair of connectors. As a result, when the cantilever beams reach the crest of the ramp member, the forward inertia carries the connector forward thus insuring that the electrical connection is made.

When the structure described above is used for mating and unmating electrical connectors, the following actions occur. During movement of the pair of matable connectors toward a mated position, the cantilever beams are deflected upward by engagement of the enlarged portion by, in a preferred embodiment, a first inclined ramp surface of a double ramp member. This action develops the forces required to provide the necessary drive home force to ensure proper mating of the electrical terminals held within the electrical connectors. The cantilever beams and their enlarged portions surround the double ramp member after movement over the apex to lock the matable connectors in a mated position. The enlarged portions abut a flat lock surface of the ramp member. When the enlarged portions of the cantilever beam are deflected downward past the limit of the flat lock surface, the prow like wedge is aligned into position with the enlarged portions. As the enlarged portions are drawn back over the wedge the cantilever beams are spread apart to permit desired easy unmating of the mated connectors.

DETAILED DESCRIPTION OF THE INVENTION

Figure 1:
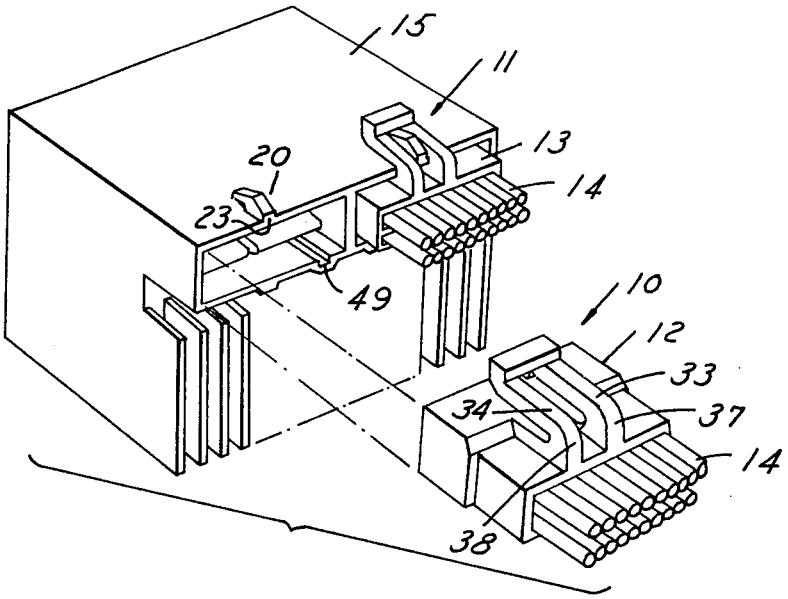
FIG. 1 is a perspective view of two pairs of matable electrical connectors, one pair being shown in the mated position and the other pair being shown in an unmated position in accordance with an embodiment of this invention.

Referring to FIG. 1, an electrical connector includes a female connector 11 and a pair of male connectors 12 and 13. Electrical wiring structure 14 is shown connected to male electrical connectors 12 and 13. The type and shape of the electrical terminals housed within male connectors 12 and 13 and female connector 11 is a matter of choice to the designer. Any one of many known different types of terminals and connectors may be utilized along with the structure of this particular invention which provides an easily releasable connector lock 10 between pairs of male and female electrical connectors.

Connector lock 10 includes a locking wedge 20 on female connector 11 and a joined beam 30 (FIGS. 2 and 4) on male connector 12. In another embodiment, (FIG. 3) a split beam 40 can be used to replace joined beam 30. The only difference, as will be discussed further, is that with joined beam 30 a pair of cantilever beams 33 and 34 rotate to spread with respect to each other. With split beam 40, cantilever beams 35 and 36 can spread apart directly without the need for an angular rotation. More than one connector lock 10 can be used between pairs of male and female connectors. Typically, however, if there are three or less electrical terminals to be connected, only a single releasable connector lock 10 is suggested.

Figure 4:
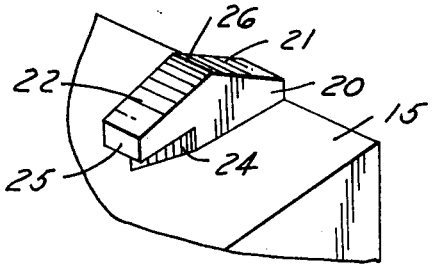
FIG. 4 is a perspective view of a second type of electrical connector adapted for mating with the connector shown in FIG. 2 or FIG. 3.

A double ramp member or locking wedge 20 is formed on the top surface 15 of female connector 11 (FIGS. 1 and 4). This double ramp member 20 has a first inclined ramp surface or front ramp 20 of a generally fixed width leading from a front face 23 of female connector 11 upwardly to an apex 16 of double ramp member 20.

A second inclined ramp surface or back ramp 22 leads downwardly from apex 26 of double ramp member 20 in a direction away from first inclined ramp surface 21 to a final position adjacent a flat lock surface 25. Flat lock surface 25 is generally perpendicular to top surface 15 and extends partially downward thereto. Between flat lock surface 25 and top surface 15 is a prow like wedge 24. Wedge 24 has a generally V or wedge shape viewed looking directly downwardly at apex 26 of double ramp member 20. The widest portion of wedge 24 is closer to apex 26 than the narrow portion of wedge 24 which is closer to flat lock surface 25.

Figure 2:
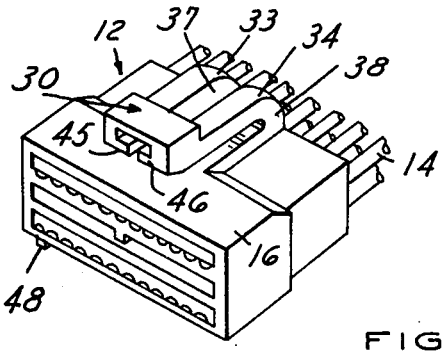
FIG. 2 is a perspective view of a first embodiment of one of the connectors using an integral or joined cantilever beam.

Male connector 12 is provided with an upper pair of cantilever beams 33 and 34 (FIG. 2). Supporting portions 37 and 38 of cantilever beams 33 and 34, respectively, extend upwardly from a rear portion of a top surface 16 of male connector 12 and support the cantilever beams 33 and 34 so that they project forwardly therefrom in a parallel spaced relationship towards the front face 23 of female connector 11. The spacing between the cantilever beams 33 and 34 is slightly greater than the generally fixed width of front ramp 21 of double ramp member 20.

Each of the cantilever beams 33 and 34 has, at its free end, a corresponding one of enlarged portions 45 and 46. The enlarged portions 45 and 46 each project into the space between beams 33 and 34 towards, but not into engagement with, each other. Thus, a space exists between opposed enlarged portions 45 and 46. Each of the enlarged portions 45 and 46 has a cam releasing surface or unlocking cam surface 51 thereon, which can be seen in FIGS. 7 through 10. When cam releasing surface 51 is viewed from directly above cantilever beams 33 and 34, this releasing surface 51 is seen as inclined inwardly from the small space between enlarged portions 45 and 46 of cantilever beams 33 and 34 generally toward a rear or attached portion of the associated cantilever beam.

Figure 5:
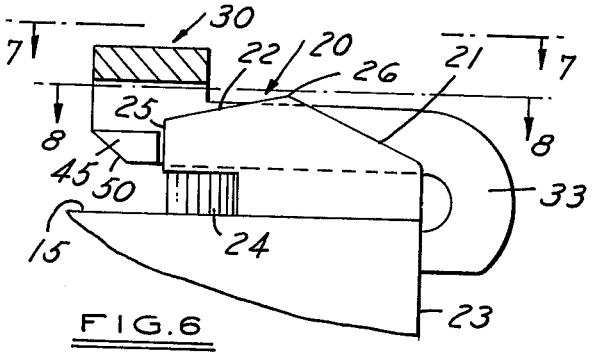
FIG. 5 is a side elevation view, partly in section, of a mated first and second connector.
Figure 6:
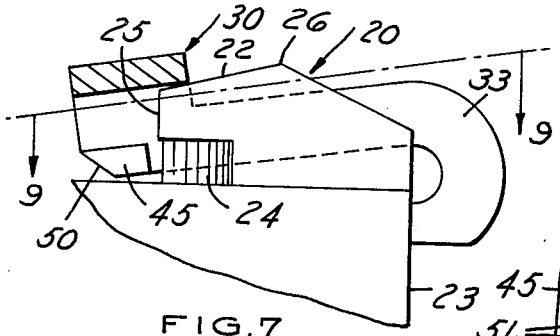
FIG. 6 is a view similar to FIG. 5 with the cantilever beam deflected in preparation for unmating.

Each of the enlarged portions 45 and 46 of cantilever beams 33 and 34 has a cam surface 50 best seen in FIGS. 5 and 6. This cam surface 50, when viewed from front face 23 toward electrical connector 12, extend generally downwardly and rearwardly with respect to the top surface of each of the cantilever beams 33 and 34.

Figure 3:
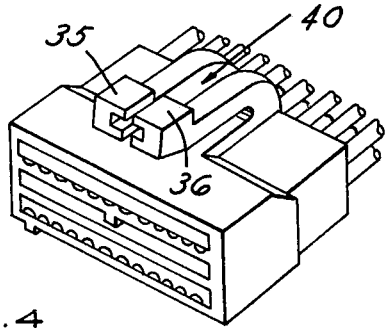
FIG. 3 is similar to FIG. 2 which is a second embodiment of an electrical connector with a split cantilever beam.

As best seen in FIGS. 1 and 3, a drawer slide type structure is provided for electrical connectors 11 and 12 to align the connectors during mating operation. The drawer slide structure consists of a raised portion 48 (FIG. 2) formed in male connector 12 and a grooved recess 49 (FIG. 1) formed in female connector 11. When connectors 11 and 12 are being brought to a mated condition, grooved recess 49 is guided by raised portion 48 to assure accurate alignment of cantilever beams 33 and 34 and the double ramp member 20.

OPERATION

The easily releasable connector lock 10 of this invention provides a normally high resistance to undesired unmating, as contrasted to a repositioning of the cantilever beams which then provide a reduced resistance for unmating when desired. Male connector 12 and female connector 11 are brought together so that raised portion 48 of male connector 12 is located in the grooved recess 49 of female connector 11. The connectors are then moved towards each other. That action causes the cantilever beams 33 and 34 to be deflected upwardly from top surface 16 of male connector 12, due to the cam locking surface 50 of enlarged portions 45 and 46 of cantilever beams 33 and 34 engaging and moving upwardly along first inclined ramp or front ramp 21 of double ramp member 20. The purpose of this deflecting action is to require a corresponding build up of mating force to be developed to overcome the resistance forces caused by pushing the cantilever beams up the ramps. When the cantilever beams pass over apex 26 of double ramp member 20, ramp resistance forces are decreased and the male connector and the female connector are driven together by the sufficient mating force to insure that an internal blade terminal is properly united with a receiving terminal, thereby assuring proper electrical connection.

FIG. 5 illustrates electrical connectors 11 and 12 in a locked condition. In this condition, cantilever beams 33 and 34 and the enlarged portions 45 and 46 thereof surround the double ramp member 20 to retain the connectors in their mated position. In particular, enlarged portions 45 and 46 are adjacent front flat lock surface 25 so that any attempt to unmate the two connectors results in flat surfaces abutting each other and does not cause spreading of cantilever beams 33 and 34.

When one desires to unmate the mated connectors, cantilever beams 33 an 34 are squeezed or depressed towards the upper surface as shown in FIG. 6. Accordingly, enlarged portions 45 and 46 are aligned with prow like wedge 24 so that an unmating or pulling of electrical connectors 11 and 12 apart causes spreading of cantilever beams 33 and 34. Cam releasing surfaces 51, on beams 33 and 34, are drawn along wedge 24 to thereby spread cantilever beams 33 and 34 apart and permit easy unmating of the matable connectors. In this unmating operation, since cantilever beams 33 and 34 are not permitted to deflect upwardly from the top surface 16 of male connector 12, no substantial resistance forces to the unmating of the connectors are developed.

Figure 11:
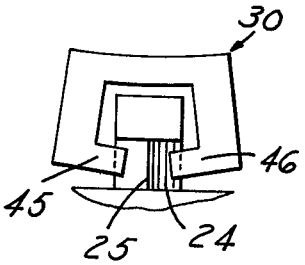
FIG. 11 is a front elevation view of an integral cantilever beam during unmating.
Figure 10:
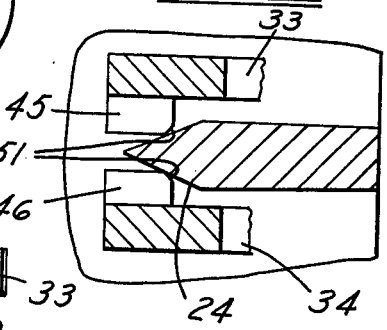
FIG. 10 is a view similar to FIG. 9 after umating of the two connectors has started and the prow like wedge is starting to spread the enlarged portions of the two cantilever beams from each other.
Figure 7:
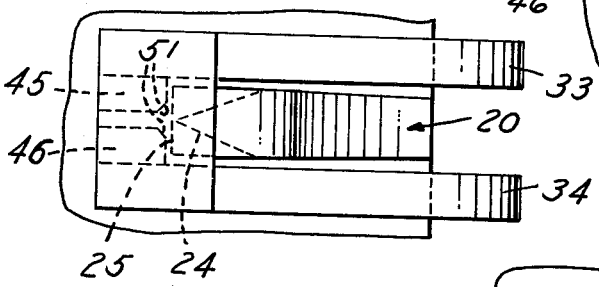
FIG. 7 is a plan view taken along section line 7—7 of FIG. 5 with the features of the prow like wedge for spreading the enlarged portion of the cantilever beam shown in dotted outline.
Figure 9:
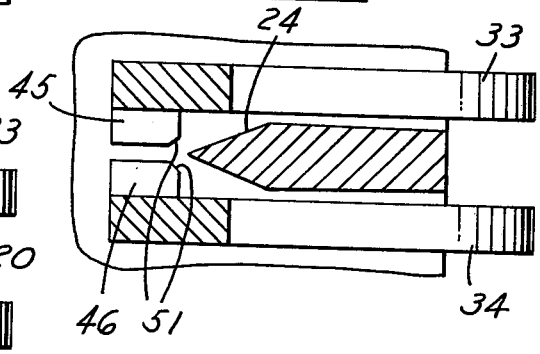
FIG. 9 is a section view taken along line 9—9 of FIG. 6.
Figure 8:
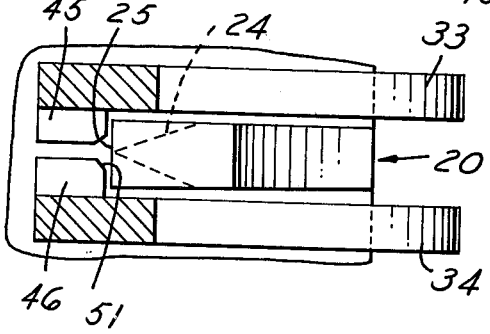
FIG. 8 is a section view taken along section line 8—8 of FIG. 5.

FIGS. 7, 8 and 9 show various cross sections viewed from the top of the joined beam 30 and double ramp member 20 just before unmating. FIG. 10 shows the spreading apart of enlarged portions 45 and 46 by wedge 24 during the unmating process. FIG. 11 shows a partially unmated connector 12 and the bending of the top side or strap of joined beam 30 to permit enlarged portions 45 and 46 to spread apart.

Various modifications and variations will no doubt occur to those skilled in the various arts to which this invention pertains. For example, the relative sizes of the locking wedge and cantilever beams may be varied from that disclosed herein. These and all other variations which basically rely on the teachings through which this disclosure has advanced the art are properly considered within the scope of this invention.

I claim:

1. A pair of matable electrical connectors comprising:

a ramp member formed on a first of said pair of matable connectors having a generally fixed width with a flat lock surface generally perpendicular to the direction of movement to mate said pair of electrical connectors, and a prow like wedge positioned adjacent said flat lock surface and pointing away from a second of said pair of matable connectors;

a pair of cantilever beams formed on said second of said pair of matable connectors, supporting portions of each of said cantilever beams extending upwardly from a rear portion of a surface of said second connector with said cantilever beams projecting forwardly therefrom in a parallel, spaced relationship toward a front face of said first connector; the spacing between said cantilever beams being slightly greater than said generally fixed width of said ramp member; each of said cantilever beams having at its free end an enlarged portion which projects into the space between said cantilever beams towards, but not into engagement with, said enlarged portion on the other one of said cantilever beams whereby a space exists between said enlarged portions, whereby said cantilever beams are deflected upwardly by engagement with said ramp member and said enlarged portions pass over said ramp member and are positioned adjacent said flat lock surface so as to lock together said pair of matable electrical connectors, and whereby deflection of said cantilevered beams positions said enlarged portions adjacent said prow like wedge and drawing said enlarged portions along said wedge of said ramp member spreads said cantilever beams apart to permit easy unmating of said matable connectors.

2. A pair of matable electrical connectors as recited in claim 1 wherein:

said ramp member has a first inclined ramp surface of generally fixed width leading from said front face of said first connector upwardly to an apex and a second surface leading from said apex in a direction away from said first inclined ramp surface to said flat lock surface;

said apex being intermediate said front face and said flat lock surface; and said second surface overlying said prow like wedge when viewed looking directly downwardly at said apex, the wide portion of said wedge being closer to said apex than the narrow portion of said wedge.

3. A pair of matable electrical connectors as recited in claim 2 wherein said second surface is an inclined ramp leading downwardly from said apex in a direction away from said first inclined ramp surface to said flat lock surface.

4. A pair of matable electrical connectors as recited in claim 3 wherein:

said cantilever beams are joined at a top side away from said ramp members, said top side bending so that said enlarged portions can be spread apart from one another to pass around said first inclined surface.

5. A pair of matable electrical connectors as recited in claim 4 wherein:

each of said enlarged portions has a cam releasing surface which, when viewed from directly above said cantilever beams is inclined inwardly from said small space between said enlarged portions generally toward a rear portion of said cantilever beams with which said enlarged portion is associated, each of said enlarged portions also having a cam locking surface which, when viewed from said front face of said first connector, extends generally downwardly and rearwardly from a top surface of each of said cantilever beams.

6. A pair of matable electrical connectors as recited in claim 5 wherein:

drawer slide means are provided in part of one of said connectors and in part of the other of said connectors, said drawer slide means for guiding the matable electrical connectors towards their mated position in a manner such that said pair of cantilever beams are accurately aligned with said ramp member during movement of the matable connectors to their mated position.

* * * * *